US008005398B2

(12) United States Patent
Itabashi

(10) Patent No.: US 8,005,398 B2
(45) Date of Patent: Aug. 23, 2011

(54) PROCESS CARTRIDGE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 137 days.

(21) Appl. No.: 12/567,818

(22) Filed: Sep. 28, 2009

(65) Prior Publication Data

US 2010/0080621 A1 Apr. 1, 2010

(30) Foreign Application Priority Data

Sep. 29, 2008 (JP) ..... 2008-249519

(51) Int. Cl.
*G03G 21/18* (2006.01)

(52) U.S. Cl. ..... 399/114

(58) Field of Classification Search ..... 399/111, 399/113, 114
See application file for complete search history.

(56) References Cited

U.S. PATENT DOCUMENTS

| | | | | |
|---|---|---|---|---|
| 7,062,201 | B2 | 6/2006 | Mizoguchi | |
| 7,792,464 | B2 * | 9/2010 | Okabe et al. | 399/228 |

FOREIGN PATENT DOCUMENTS

| | | |
|---|---|---|
| JP | 5297646 | 11/1993 |
| JP | 2001-282079 | 10/2001 |
| JP | 2002-182541 | 6/2002 |
| JP | 2005-141140 | 6/2005 |
| JP | 2008-015055 | 1/2008 |

* cited by examiner

*Primary Examiner* — David P Porta
*Assistant Examiner* — Mark R Gaworecki
(74) *Attorney, Agent, or Firm* — Banner & Witcoff, Ltd.

(57) ABSTRACT

A process cartridge includes a cylindrical image carrier, a developing roller, a process case, and a cover removably fitted to the process case. The image carrier and the developing roller are relatively movable in the process case between a contact position in which the image carrier contacts the developing roller and a separated position in which the image carrier is separated from the developing roller. A releasing member is provided at the cover. The releasing member can be interposed into a released position between an end portion of the image carrier and an end portion of the developing roller. In a state in which the cover is fitted to the process case and covers the image carrier, the releasing member is movable from an unreleased position, in which the contact between the image carrier and the developing roller is not released, to a released position.

16 Claims, 12 Drawing Sheets

PROCESS CARTRIDGE

CROSS-REFERENCE TO RELATED APPLICATIONS

This application claims priority from Japanese Patent Application No. 2008-249519 filed on Sep. 29, 2008, the entire contents of which are incorporated herein by reference.

TECHNICAL FIELD

The present invention relates to a process cartridge detachably attachable to a main body of an image forming apparatus.

BACKGROUND

A process cartridge stores an image carrier (photosensitive drum) and a developing roller. The image carrier is formed as a cylindrical member such that an electrostatic latent image can be formed on a surface (latent image forming surface) of a photosensitive layer formed on its outer periphery. The developing roller is formed as a circular column member and arranged such that this roller contacts elastically with the image carrier during an image forming operation. Specifically, a synthetic rubber layer is formed on the outside of a developing roller shaft constituting a rotation center axis of the developing roller. A dry developer (referred to as a "dry toner" or simply as a "toner" hereinafter) is carried on a peripheral surface of the developing roller.

A cover may be fitted to the process cartridge so as to cover and protect the image carrier when the process cartridge of this type is not fitted to the main body of the image forming apparatus (during the custody, the conveyance, or the like). The cover may include a member (a separating member) for separating the image carrier from the developing roller which is provided integrally with this cover.

In such configuration, when the cover is fitted to the process cartridge to cover the image carrier, the image carrier is separated from the developing roller by the separating member. Accordingly, the image carrier can be protected from an impact or the like applied from the outside, and also the damage (pressured indent or soiling) caused when the image carrier and the developing roller continue to contact in the same position for a long term can be prevented effectively.

SUMMARY

The image carrier and the developing roller are caused to contact at a predetermined pressure. Therefore, in order to fit the above-described cover to the process cartridge, the separating member must apply a force that can cause both members to separate against the pressure. That is, a predetermined resistance is produced in fitting the cover to the process cartridge.

When such resistance is produced, the fitting of the cover may be rendered incomplete. Alternately, when the cover is put strongly to the process cartridge to such extent that the force can prevail against such resistance, the defect, e.g., the latent image forming surface is scratched, the process cartridge or the cover is damaged, may be caused.

The present invention has been made in consideration of the above-described circumstances, and an object thereof is to protect more adequately an image carrier with a simple structure.

According to an aspect of the invention, there is provided a process cartridge detachably attachable to a main body of an image forming apparatus, said process cartridge comprising: a cylindrical image carrier extending in an axial direction thereof from a first end portion thereof to a second end portion thereof, the image carrier on which an electrostatic latent image is formed; a column developing roller extending substantially along the axial direction from a first end portion thereof to a second end portion thereof, the developing roller being configured to carry a developer on a peripheral surface thereof so as to develop the electrostatic latent image by the developer when the developing roller contact the image carrier during an image forming operation; a process case configured to store the image carrier and the developing roller such that the image carrier and the developing roller are relatively movable between a contact position in which the image carrier contacts the developing roller and a separated position in which the image carrier is separated from the developing roller; a cover removably fitted to the process case so as to cover the image carrier in a state in which the process cartridge is detached from the main body of the image forming apparatus, the cover having a first end portion and a second end portion opposite to the first end portion in the axial direction when the cover is fitted to the process case; and a first releasing member provided at the first end portion of the cover, the first releasing member being configured to release a contact between the image carrier and the developing roller when the first releasing member is interposed into a first released position between the first end portion of the image carrier and the first end portion of the developing roller; wherein the first releasing member is movable from a first unreleased position, in which the contact between the image carrier and the developing roller is not released, to the first released position in a state in which the cover is fitted to the process case and covers the image carrier.

According to another aspect of the invention, there is provided a process cartridge detachably attachable to a main body of an image forming apparatus, said process cartridge comprising: an image carrier extending in an axial direction thereof; a developing roller extending substantially along the axial direction; a process case configured to store the image carrier and the developing roller such that the image carrier and the developing roller are relatively movable between a contact position in which the image carrier contacts the developing roller and a separated position in which the image carrier is separated from the developing roller; and a cover removably fitted to the process case so as to cover the image carrier in a state in which the process cartridge is detached from the main body of the image forming apparatus, the cover comprising a releasing member movable from a first position to a second position in a first direction relative to the process case in a state in which the cover is fitted to the process case, wherein the releasing member is positioned at the first position when the image carrier and the developing roller are positioned at the contact position, wherein the releasing member positioned at the second position is interposed between the developing roller and the movable which are positioned at the separated position, and wherein the first direction is different from a second direction for fitting the cover to the process cartridge.

According to a yet another aspect of the invention, there is provided a process cartridge detachably attachable to a main body of an image forming apparatus, said process cartridge comprising: an image carrier extending in an axial direction thereof; a developing roller extending substantially along the axial direction; a process case configured to store the image carrier and the developing roller such that the image carrier and the developing roller are relatively movable between a contact position in which the image carrier contacts the developing roller and a separated position in which the image carrier is separated from the developing roller; and a cover removably fitted to the process case so as to cover the image carrier in a state in which the process cartridge is detached from the main body of the image forming apparatus, the cover comprising a releasing member movable from a first position to a second position in a state in which the cover is fitted to the process case, wherein the releasing member is positioned at the first position when the image carrier and the developing roller are positioned at the contact position, wherein the releasing member positioned at the second position is interposed between the image carrier and the developing roller which are positioned at the separated position, and wherein when a state of the cover is changed from a removed state to a fitted state with respect to the process case, the releasing member is positioned at the first position.

DESCRIPTION

Embodiments of the present invention will be explained with reference to the drawings hereinafter.

Here, the description about the following embodiments will give merely an example of embodiments of the present invention. Therefore, as described later, the present invention should not be limited to particular configurations explained hereinafter at all. Various modifications that are applicable to the present embodiments are set forth collectively in the end of the specification, for the consistent understanding of the embodiments is impeded when these modifications are inserted in the middle of the description of the present embodiment.

<Overall Configuration of Laser Printer>

Figure 1:
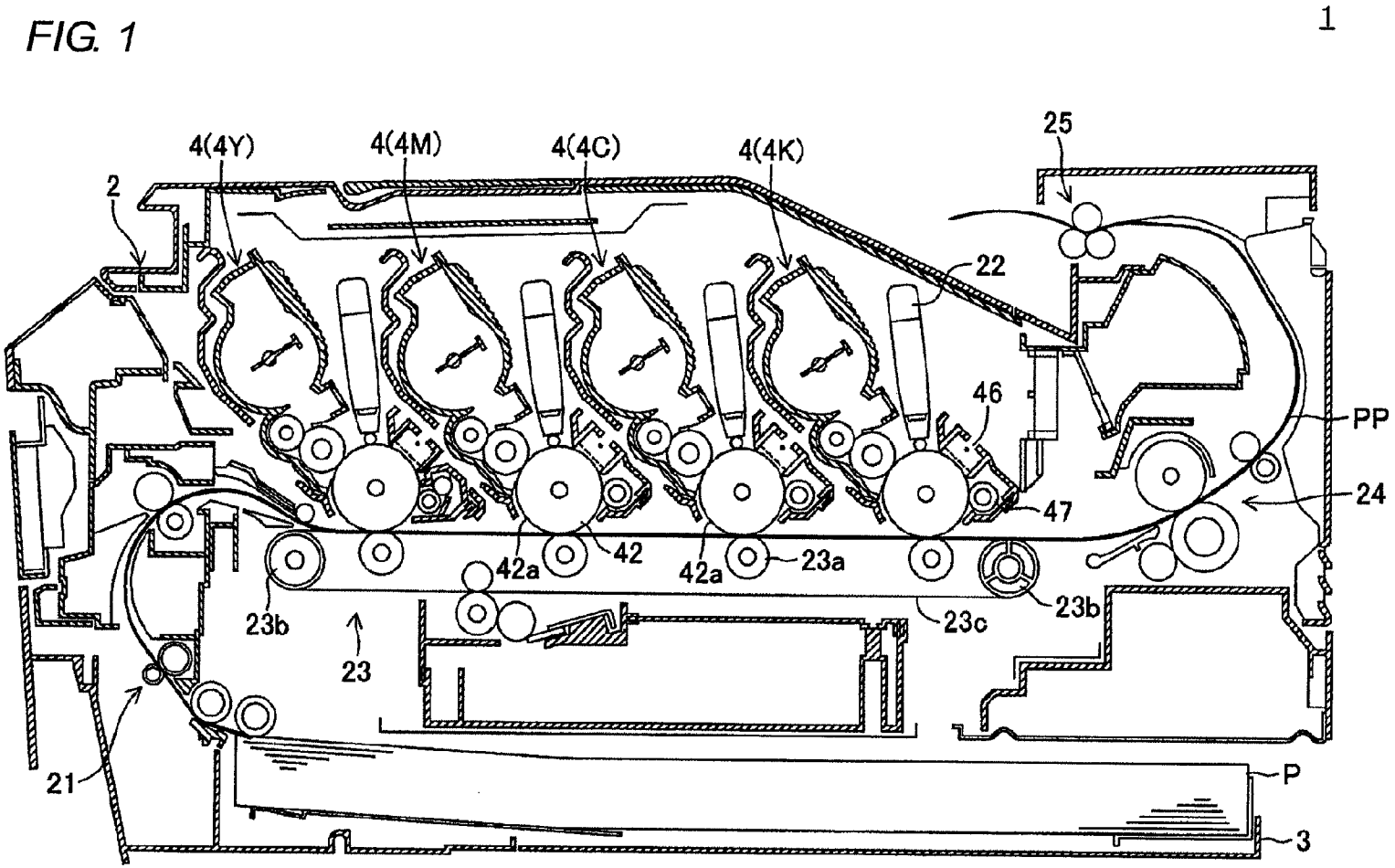
FIG. 1 is cross sectional view of a laser printer as an example of an image forming apparatus to which the present invention is applied.

FIG. 1 is a cross sectional view of a laser printer 1 as an example of an image forming apparatus is applied. In this case, a lateral direction in FIG. 1 is referred to as a "back and forth direction" hereinafter, and a direction intersecting orthogonally with both the back and forth direction and a height direction (a vertical direction in FIG. 1) (a direction perpendicular to a sheet of a paper in FIG. 1) is referred to as a "main scanning direction" hereinafter. An overall configuration of the laser printer 1 will be explained with reference to FIG. 1 hereunder.

The laser printer 1 forms an image on a paper P by using the impalpable powder dry toner (referred simply as a "toner" hereinafter) as the dry developer. This laser printer 1 is equipped with a main body portion 2, a paper cassette 3, and a process cartridge 4.

Various mechanisms (their details will be described later) for executing an image formation on the paper P by using the toner while carrying the paper P along a paper feeding path PP are provided in the main body portion. The paper cassette 3 is provided at the bottom portion of the main body portion 2. This paper cassette 3 is fitted to the main body portion 2 such that this cassette can be detachably attached by sliding in the back and forth direction. Many sheets of papers are stored in the paper cassette 3 in a stacked state.

The process cartridge 4 is stored in the main body portion 2 to be detachably attached. The toner is accommodated in the process cartridge 4. As described later, when the toner is fed (transferred) from the process cartridge 4 to the paper P, an image (referred to as a "toner image" hereinafter) is formed on the paper P by the toner.

In the laser printer 1 of the present embodiment, an image formation in multiple colors (in full color) can be done by using four color toners, i.e., yellow, magenta, cyan, and black. Concretely, a plurality of process cartridges 4 (4Y, 4M, 4C, 4K) are aligned in this order at the location, which extends substantially linearly in the back and forth direction when viewed from the side, of the paper feeding path PP in the main body portion 2. The yellow, magenta, cyan, and black toners are accommodated in the process cartridges 4Y, 4M, 4C, and 4K respectively.

<Internal Configuration of Main Body Portion>

Details of an internal configuration of the main body portion 2 will be explained with reference to FIG. 1 hereunder.

A paper feeding portion 2I is configured to pick up the uppermost sheet out of many sheets of papers P loaded in the paper cassette 3, and then feeds the picked-up sheet toward the process cartridge 4Y, which is located on the most upstream side in the paper feeding direction, out of a plurality of process cartridges 4.

An exposing portion 22 is configured to emit a laser beam of a predetermined wavelength that is modulated in response to image information (ON/OFF is controlled). In the present embodiment, a plurality of exposing portions 22 are provided to correspond to a plurality of process cartridges 4 respectively.

A transferring portion 23 is provided such that this portion opposes to a plurality of process cartridges 4 (4Y, 4M, 4C, 4K) aligned as described above in the main body portion 2 respectively. The transferring portion 23 is configured to transfer the toner image to the paper P while feeding the paper P along the location, which extends substantially linearly in the back and forth direction when viewed from the side, of the paper feeding path PP. Concretely, the transferring portion 23 has a transfer roller 23*a*, a pair of belt driving rollers 23*b*, and a paper feeding belt 23*c*.

The transfer roller 23*a* is arranged in parallel with the main scanning direction, and is configured to rotate around a shaft that is parallel with the main scanning direction. This transfer roller 23*a* is connected to a predetermined power supply (not shown) such that a predetermined bias voltage is applied to the transfer roller to attract electrostatically the toner. In the present embodiment, a plurality of transfer rollers 23*a* are aligned along the location, which extends substantially linearly in the back and forth direction when viewed from the side, of the paper feeding path PP as many as the process cartridges 4.

One of a pair of belt driving rollers 23*b* is arranged in the further upstream side in the paper feeding direction rather than the transfer roller 23*a* that opposes to the process cartridge 4Y located on the most upstream side. The other of a pair of belt driving rollers 23*b* is arranged in the further downstream side in the paper feeding direction rather than the transfer roller 23*a* that opposes to the process cartridge 4K located on the most downstream side.

A pair of belt driving rollers 23*b* are arranged in parallel with the main scanning direction, and is configured to be rotated around a shaft that is parallel with the main scanning direction. Then, either of a pair of belt driving rollers 23*b* can be rotated/driven by a driving source such as a motor (not shown), or the like.

The paper feeding belt 23*c* is spread over a pair of belt driving rollers 23*b* such that its inner surface contacts a peripheral surface of the transfer roller 23*a*. An outer surface of this paper feeding belt 23*c* is caused by the rotation/drive of a pair of belt driving rollers 23*b* to move on an almost elliptic orbit when viewed from the side.

A fixing portion 24 is provided on the downstream side of the transferring portion 23 in the paper feeding direction. The fixing portion 24 is configured to apply a pressure and a heat to the paper P, on which the toners are transferred by the transferring portion 23, to fix the toner on the paper P.

A paper ejecting portion 25 is provided on the downstream side of the fixing portion 24 in the paper feeding direction. The paper ejecting portion 25 is configured to eject the paper P, on which the toners are fixed by the fixing portion 24, to the outside of the main body portion 2.

<Process Cartridge>

Figure 2:
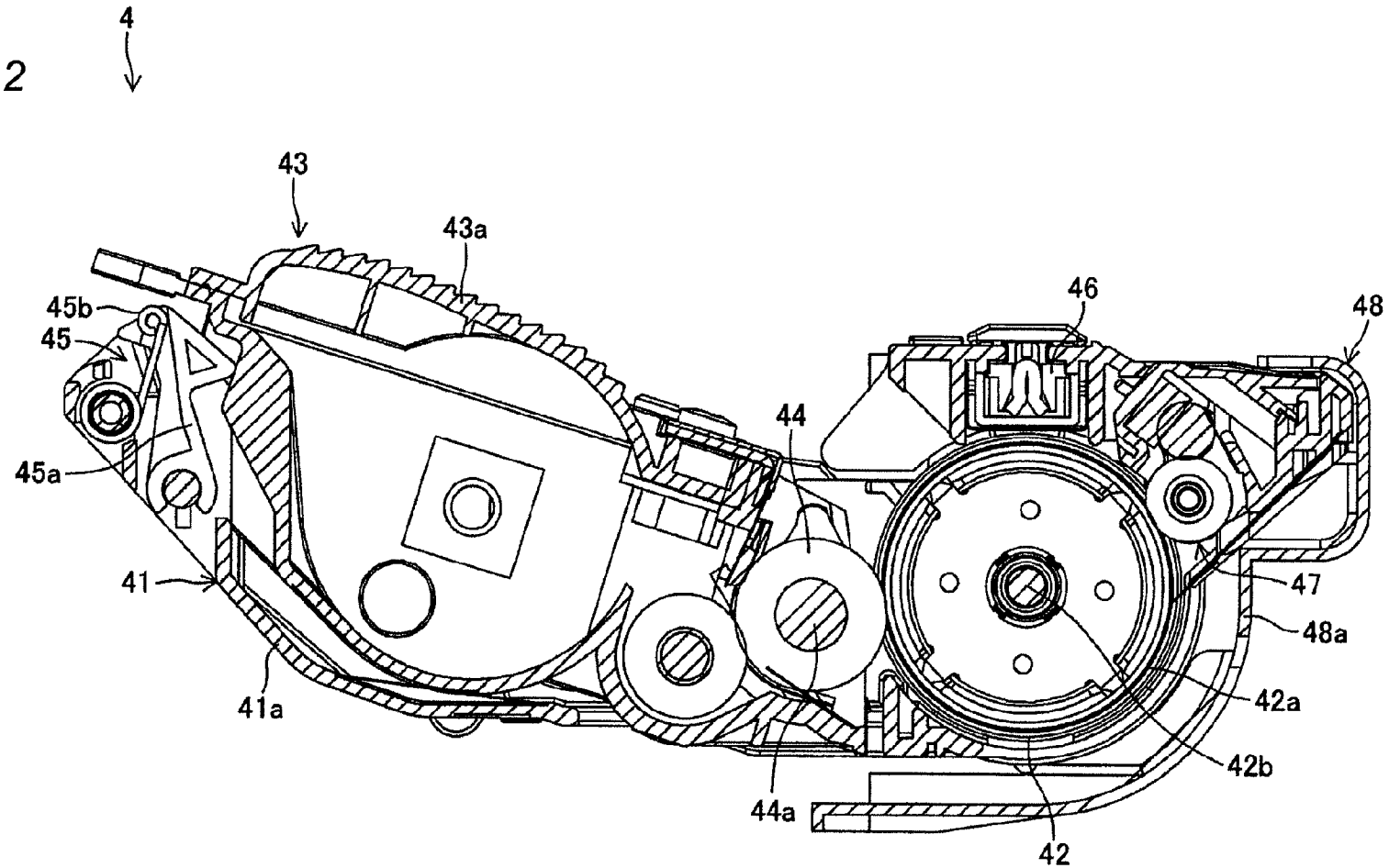
FIG. 2 is a cross sectional view showing a process cartridge shown in FIG. 1 in an enlarged manner.
Figure 3A:
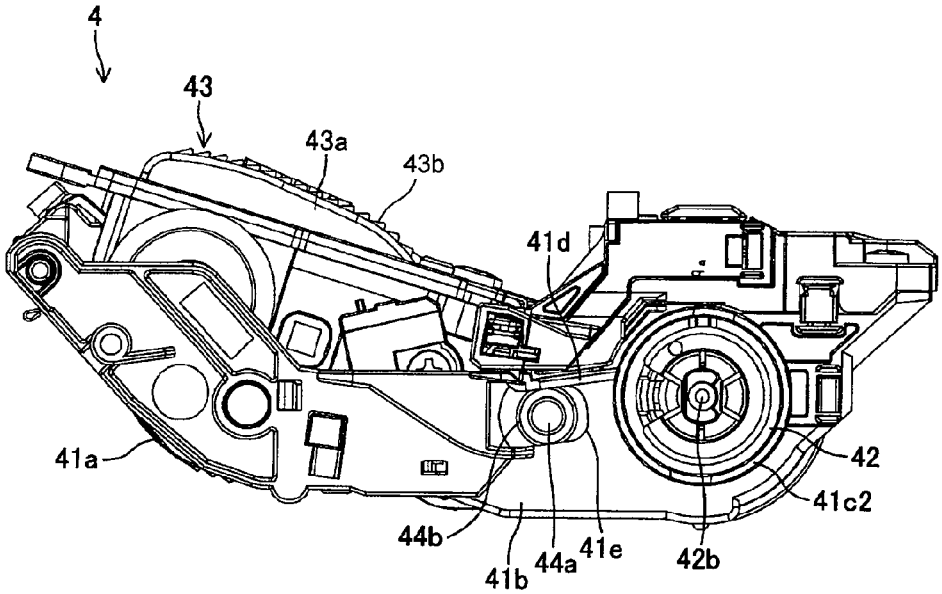
FIG. 3A is a side view showing an external appearance of a process cartridge shown in FIG. 2.
Figure 3B:
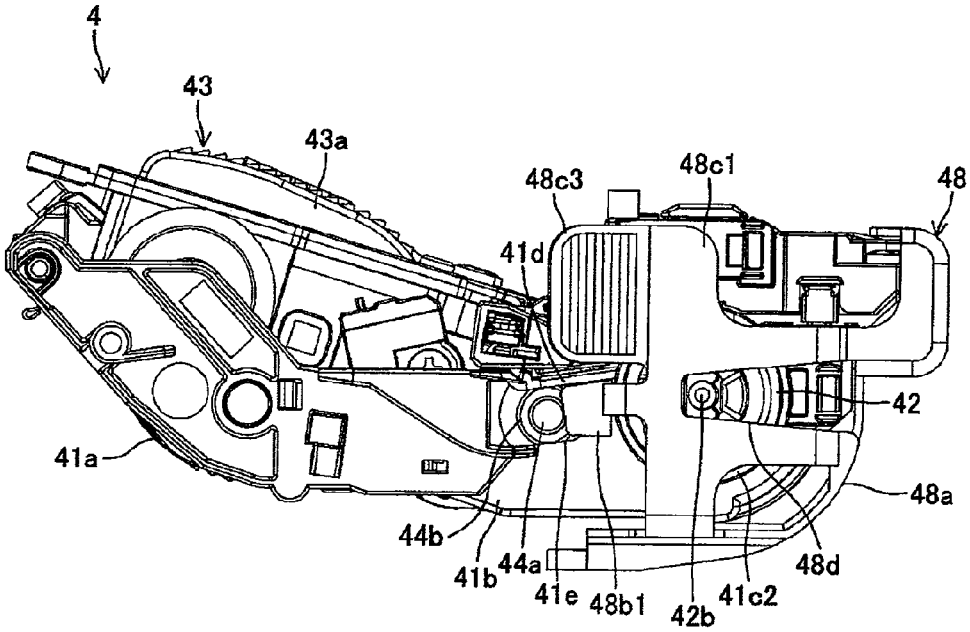
FIG. 3B is a side view showing an external appearance of a process cartridge shown in FIG. 2.
Figure 3C:
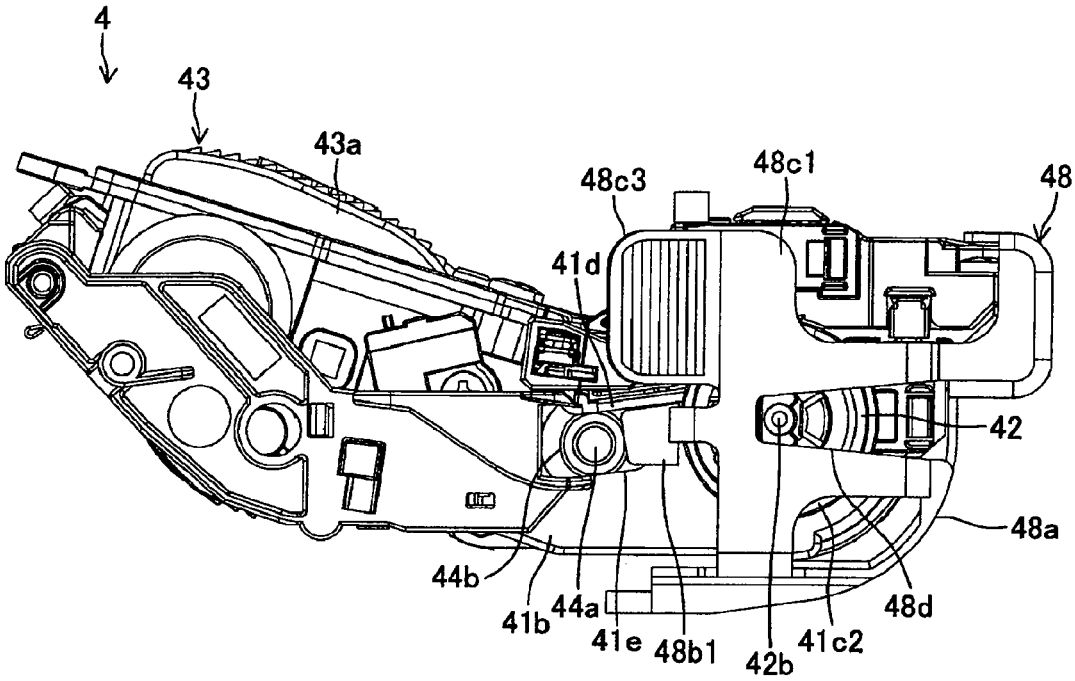
FIG. 3C is a side view showing an external appearance of the process cartridge shown in FIG. 2.
Figure 4:
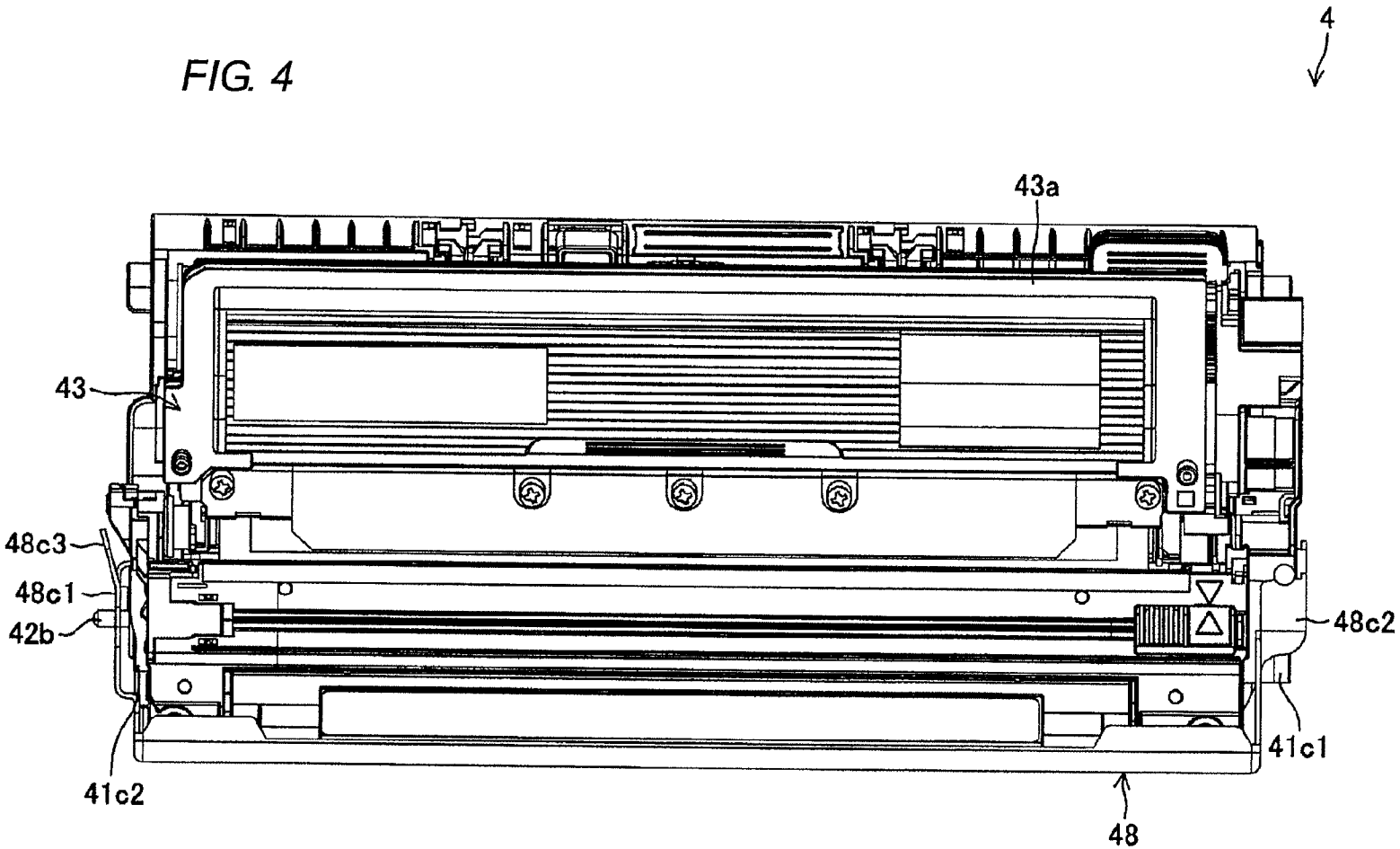
FIG. 4 is a plan view showing an external appearance of the process cartridge shown in FIG. 2.
Figure 5:
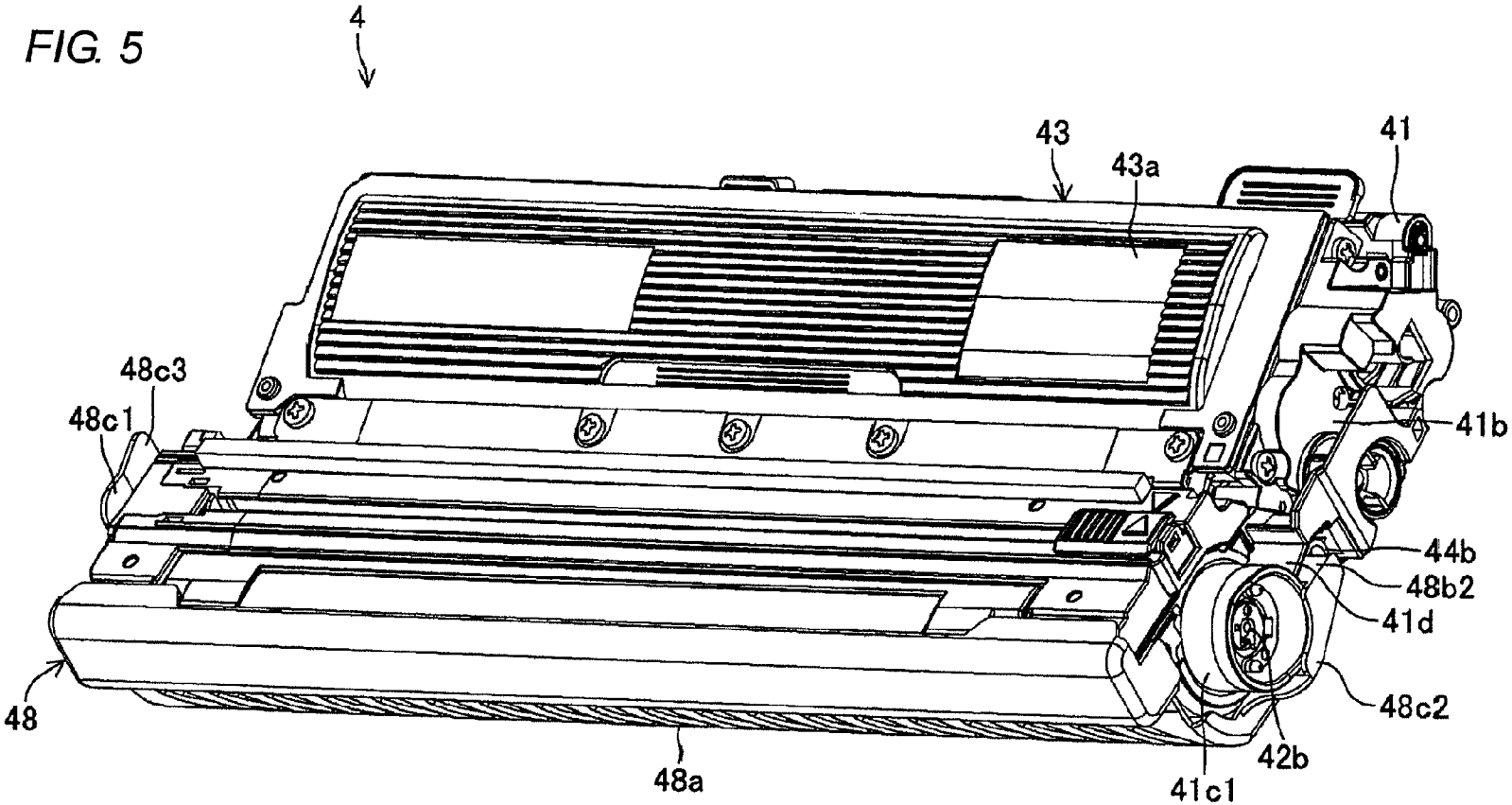
FIG. 5 is a perspective view showing an external appearance of the process cartridge shown in FIG. 2.

FIG. 2 is a cross sectional view showing the process cartridge 4 shown in FIG. 1 in an enlarged manner. FIG. 3A to FIG. 3C are side views showing an external appearance of the process cartridge 4 shown in FIG. 2. FIG. 4 is a plan view showing an external appearance of the process cartridge 4 shown in FIG. 2. FIG. 5 is a perspective view showing an external appearance of the process cartridge 4 shown in FIG. 2. A detailed configuration of the process cartridge 4 in the present embodiment will be explained with reference to FIG. 2 to FIG. 5 hereunder.

By reference to FIG. 2, FIG. 3A to FIG. 3C, a process case 41 acting as a case of the process cartridges 4 has a bottom plate 41*a*, and a pair of side plates 41*b* provided to both ends of this bottom plate 41 a in the main scanning direction. The process case 41 is formed integrally of a synthetic resin.

By reference to FIG. 3A to FIG. 3C, FIG. 4, and FIG. 5, an engaging projecting portion 41*c*1 is provided to one of side plates 41*b* to project outwardly. That is, the engaging projecting portion 41*c*1 is provided to one end portion of the process case 41 in the main scanning direction. Also, the engaging projecting portion 41*c*1 is provided to one end portion in the longitudinal direction (the lateral direction in FIG. 3A to FIG. 3C) of the side plates 41*b*. This engaging projecting portion 41*c*1 is formed like a cylindrical shape that can be used to align the process cartridge 4 with the main body portion 2.

A drum storing portion 41*c*2 is provided in a position on the other of the side plates 41*b*, which corresponds to the engaging projecting portion 41*c*1 in the main scanning direction. The drum storing portion 41*c*2 is formed like a cylindrical shape such that this portion 41*c*2 as well as the engaging projecting portion 41*c*1 supports rotatably both end portions of a photosensitive drum 42 described later in the axial direction.

A restricting rib 41*d* as an example of a holding mechanism is provided to the side plates 41*b* respectively to project outwardly. The restricting rib 41*d* is provided in the position that is adjacent to the engaging projecting portion 41*c*1 and the drum storing portion 41*c*2 and on the other end portion side in the longitudinal direction of the side plate 41*b*. An opening portion 41*e* is provided as a substantially rectangular through hole having a longitudinal direction thereof in a predetermined contacting direction along a longitudinal direction of the side plate 41*b*. Also, the restricting rib 41*d* is provided along the contacting direction at one end portion (an upper end portion in FIG. 3A to FIG. 3C) of the opening portion 41*e* in a width direction perpendicular to the longitudinal direction of the opening portion 41*e*.

By reference to FIG. 2, the above photosensitive drum 42 as an example of an image carrier is formed of a cylindrical member, and allows the electrostatic latent image to be formed on its peripheral surface as a latent image forming surface 42*a*. The photosensitive drum 42 is stored in the process case 41 in positions corresponding to the engaging projecting portion 41*c*1 and the drum storing portion 41*c*2 (see FIG. 3A and FIG. 5).

The photosensitive drum 42 is supported by the engaging projecting portion 41*c*1 and the drum storing portion 41*c*2 such that this drum can be rotated around a drum shaft 42*b* that is arranged in parallel with the main scanning direction (the axis direction of the photosensitive drum 42). As shown in FIG. 4, the drum shaft 42*b* is provided such that one end portion (end portion on the drum storing portion 41*c*2 side) projects to the outside from the side plate 41*b*.

A developing unit 43 is stored in the inside of a recess portion surrounded by the bottom plate 41*a* and a pair of side plates 41*b* in the process case 41. The developing unit 43 is detachably attached to the process case 41. The above toner is accommodated in a developing unit case 43*a* acting as a case of the developing unit 43 not to leak to the outside.

Also, a developing roller 44 is supported rotatably by the developing unit case 43*a*. The developing roller 44 is formed of a circular column member that is formed of a semiconductor synthetic rubber layer on a periphery of a developing roller shaft 44*a* that is formed of a metal rod-like member. The developing roller 44 is provided to the end portion of the developing unit case 43*a* such that most (half or more) of the circular column peripheral surface in the circumferential direction is exposed to the outward of the developing unit 43 over the full width in the axial direction.

When the developing roller 44 is rotation-driven, the charged toner is carried on the above peripheral surface like a uniform thin layer and also the thin layer toner is fed to the latent image forming surface 42*a* of the photosensitive drum 42. Then, the developing unit 43 is configured such that the developing roller 44 is caused to come into contact with the photosensitive drum 42 during the image forming operation and thus the electrostatic latent image on the latent image forming surface 42*a* is developed by the toner.

By reference to FIG. 3A to FIG. 3C, a developing roller shaft bearing 44*b* is fitted into both end portions to cover both end portions of the developing roller shaft 44*a* acting as the rotation center axis of the developing roller 44 respectively. The developing roller shaft bearing 44*b* is formed of a cylindrical member that is made of an insulating synthetic resin. The developing roller shaft bearing 44*b* is provided to pass through the opening portion 41*e* and project to the outside of the opening portion 41*e*. Also, the developing roller shaft bearing 44*b* can be moved reciprocally in the opening portion 41*e* along the above contact direction.

In this manner, in the present embodiment, the developing roller shaft bearing 44*b* is guided by the opening portion 41*e*, and thus the developing unit 43 is slid in the process case 41 along the contact direction as the longitudinal direction of the opening portion 41*e*. Accordingly, the photosensitive drum 42 and the developing roller 44 come into contact with each other and are separated away from each other.

By reference to FIG. 2, an urging mechanism 45 is provided to an end portion of the developing roller 44 in the depth direction (the lateral direction in FIG. 2: the same as the longitudinal direction of the above side plate 41*b*), which intersects orthogonally with the main scanning direction, in the position on the opposite side to the photosensitive drum 42. The urging mechanism 45 is configured to urge elastically the developing unit case 43*a* being fitted to the process case 41 toward the photosensitive drum 42.

In the present embodiment, the urging mechanism 45 has an urging lever 45*a*, and a spring 45*b*. The urging lever 45*a* has a fixed end portion supported rotatably to the bottom plate 41*a* of the process case 41 and a free end portion which can be swung. The spring 45*b* is provided to urge the free end portion of the urging lever 45*a* toward the bottom plate 41*a*.

In this manner, in the present embodiment, the urging lever 45*a* and the developing roller 44 are stored in the process case 41 to come close to each other and separate away from each other along the above contacting direction. Also, the process cartridge 4 in the present embodiment is configured such that the photosensitive drum 42 and the developing roller 44 are brought into contact with each other at a uniform and minute width on the overall latent image forming surface 42*a* in the main scanning direction by a spring force of the spring 45*b* in the urging mechanism 45.

The developing roller 44 can be moved in a direction away from the photosensitive drum 42 by applying an external force to the developing unit 40 in a direction against the urging force of the urging mechanism 45, i.e., in a direction against the load of the urging lever 45*a* (the load of the spring 45*b*). For example, the external force can be applied by the hand or finger, etc., to a part of the developing unit case 43*a* such as an upper surface 43*b* of the developing unit case 43*a* or the developing roller shaft bearing 44*b*.

In the above example, the urging mechanism 45 allows the developing unit 43 as a whole to be slidable. However, it is sufficient that the developing roller 44 and the photosensitive drum 42 are relatively movable between a contact position in which they contact each other and a separated position in which they are separated from each other. For example, in the developing unit 43, only the developing roller 44 may be movable (slidable). Further, at least one of the developing roller 44 and the photosensitive drum 42 may be movable.

Also, a charger 46 and a cleaning mechanism 47 are provided to the process case 41. The charger 46 and the cleaning mechanism 47 are arranged to oppose to the photosensitive drum 42. The charger 46 is a so-called scorotron charger, and is configured such that the latent image forming surface 42*a* can be charged uniformly before the latent image is formed. The cleaning mechanism 47 is configured such that a foreign matter (paper powder, or the like) and a residual toner on the latent image forming surface 42*a* can be removed before the latent image forming surface 42*a* is charged uniformly by the charger 46.

Returning to FIG. 1 again, as described above, the process cartridge 4 can be detachably attached to the main body portion 2 of the laser printer 1. Then, a plurality of process cartridges 4Y, 4M, 4C, and 4K are positioned by correlating respective engaging projecting portions 41*c*1 with the main body portion 2 such that positional relationships between the photosensitive drum 42 are set into predetermined states respectively and also a predetermined gap is formed between the latent image forming surfaces 42*a* and the paper feeding belt 23*c* respectively.

<Cover>

As shown in FIG. 3B to FIG. 5, when fitted to the process case 41, this cover 48 covers the photosensitive drum 42 in a state that the process cartridge 4 is detached from the main body portion 2 of the laser printer 1 (containing an unfitted state, i.e., the case where the process cartridge 4 is a new product and has never been fitted to the main body portion 2 of the laser printer 1).

Figure 6:
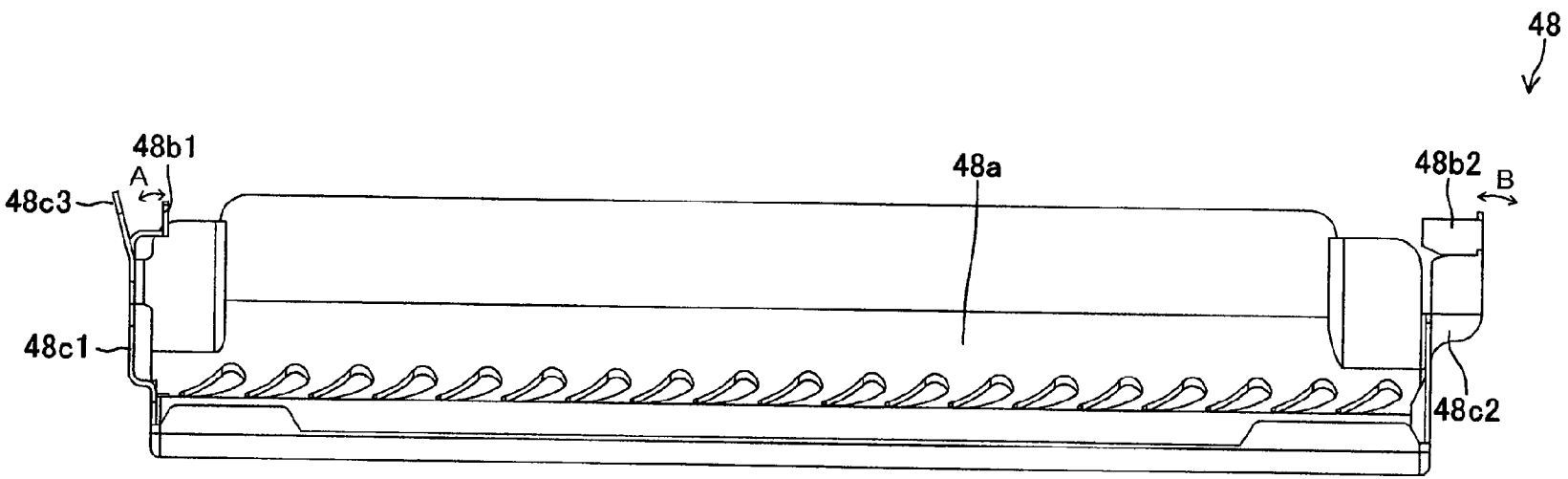
FIG. 6 is a plan view showing an external appearance of a cover shown in FIG. 3B to FIG. 5.
Figure 7A:
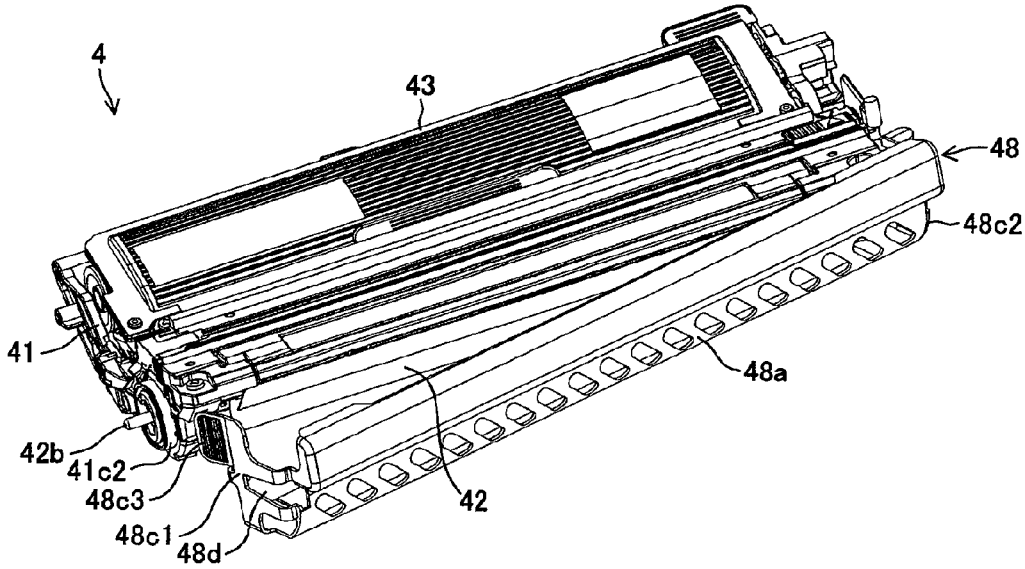
FIG. 7A is a perspective view showing how to attach/detach a cover in a process cartridge shown in FIG. 5.
Figure 7B:
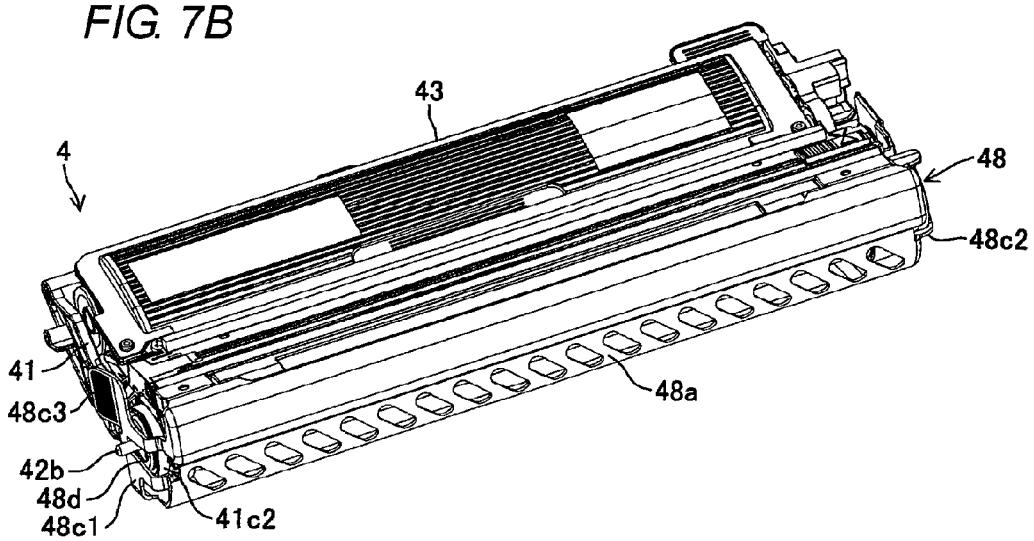
FIG. 7B is a perspective view showing how to attach/detach the cover in the process cartridge shown in FIG. 5.

FIG. 6 is a plan view showing an external appearance of the cover 48 shown in FIG. 3B to FIG. 5. FIG. 7A and FIG. 7B are perspective view showing how to attach/detach the cover 48 in the process cartridge 4 shown in FIG. 5. A concrete configuration of the cover 48 of the present embodiment will be explained with reference to FIG. 3B to FIG. 7B hereunder.

By reference to FIG. 6, the cover 48 has a cover main body 48*a*, releasing members 48*b*1 and 48*b*2, and connecting members 48*c*1 and 48*c*2. The cover 48 is formed integrally seamlessly of a synthetic resin.

As shown in FIG. 7A and FIG. 7B, the cover main body 48*a* is a member that has its longitudinal direction in the axial direction of the photosensitive drum. When the cover 48 is fitted to the process case 41, the cover main body 48*a* covers the photosensitive drum 42 and protects the photosensitive drum 42 from a contact or an impact from the outside (containing the finger of the human being).

As shown in FIG. 3C and FIG. 5, when the releasing member 48*b*1 is interposed into a predetermined releasing position between the drum storing portion 41*c*2 and the developing roller shaft bearing 44*b* and also the releasing member 48*b*2 is interposed into a predetermined releasing position between the engaging projecting portion 41*c*1 and the developing roller shaft bearing 44*b*, these members can release the foregoing contact between the photosensitive drum 42 and the developing roller 44.

Specification, by reference to FIG. 3A to FIG. 3C, when this releasing member 48*b*1 is inserted into the releasing position being put between the drum storing portion 41*c*2 and the developing roller shaft bearing 44*b*, the releasing member 48*b*1 urges the developing roller shaft bearing 44*b* against a spring force of the spring 45*b* (see FIG. 2) in the urging mechanism 45. Thus, the developing roller shaft bearing 44*b* is moved away from the drum shaft 42*b*.

Similarly, by reference to FIG. 5, when this releasing member is inserted into the releasing position being put between the drum storing portion 41*c*1 and the developing roller shaft bearing 44*b*, the releasing member 48*b*2 urges the developing roller shaft bearing 44*b* against a spring force of the spring 45*b* (see FIG. 2) in the urging mechanism 45. Thus, the developing roller shaft bearing 44*b* is moved away from the drum shaft 42*b*.

Also, by reference to FIG. 3A to FIG. 3C, an end portion of the releasing member 48*b*1 opposing to the developing roller shaft bearing 44*b* is formed like an inclined surface, when viewed from the side surface. This shape of the end portion is set such that the releasing member 48*b*1 is urged toward the restricting rib 41*d* by a load applied by the developing roller shaft bearing 44*b* by means of a spring force of the spring 45*b* in the urging mechanism 45 (load applied to bring the photosensitive drum into contact with the developing roller 44) in a state that the releasing member 48*b*1 is put in the above releasing position between the drum storing portion 41*c*2 and the developing roller shaft bearing 44*b*.

Similarly, by reference to FIG. 5, an end portion of the releasing member 48*b*2 opposing to the developing roller shaft bearing 44*b* is formed like an inclined surface, when viewed from the side surface, such that the releasing member 48*b*2 is urged toward the restricting rib 41*d* in the above releasing position.

The releasing member 48*b*1 and the connecting member 48*c*1 are provided to one end portion of the cover 48 in the longitudinal direction (the axial direction of the photosensitive drum 42). The releasing member 48*b*1 is connected to the cover main body 48*a* via the flexible connecting member 48*c*1 that can be deformed elastically. The releasing member 48*b*2 and the connecting member 48*c*2 are provided to the other end portion in the longitudinal direction of the cover 48. The releasing member 48*b*2 is connected to the cover main body 48*a* via the flexible connecting member 48*c*2 that can be deformed elastically. Accordingly, the releasing members 48*b*1 and 48*b*2 is movable in directions shown by arrows A and B shown in FIG. 6, respectively. In other words, the releasing members 48*b*1 and 48*b*2 is movable substantially along the axial direction of the photosensitive drum 42 (and the developing roller 44) when the cover 48 is fitted to the process case 41.

When the cover 48 is fitted to the process case 41 to cover the photosensitive drum 42, the connecting members 48*c*1 and 48*c*2 are deformed elastically to cause the releasing members 48*b*1 and 48*b*2 to position in the unreleased position that is positioned outer than the releasing position in the axial direction of the photosensitive drum 42 (see FIG. 3B). Also, the connecting members 48*c*1 and 48*c*2 are provided to cover (protect) the engaging projecting portion 41*c*1 and the drum storing portion 41*c*2 from the outside respectively in a state that the cover 48 is fitted to the process case 41.

In the present embodiment, the releasing member 48*b*1 and the connecting members 48*c*1 are provided to the positions of the drum shaft 42*b*, which correspond to one end portion projecting to the outer side than the drum storing portion 41*c*2. Also, the connecting members 48*c*1 is formed of a thin flat plate to elastically deform more easily than the connecting member 48*c*2.

That is, when the cover 48 is fitted to the process case 41 to cover the photosensitive drum 42, the connecting member 48*c*1 is pushed by one end portion of the drum shaft 42*b* and is elastically deformed easily. Also, the connecting member 48*c*2 has the rib-like portion that is shaped to follow a portion of the cylindrical outer shape of the engaging projecting portion 41*c*1 and projects outward, as shown in FIG. 5, and thus protects the engaging projecting portion 41*c*1 from the outside and is hard to elastically deform rather than the connecting member 48*c*1.

A grasping member 48*c*3 is provided to the connecting member 48*c*1. This grasping member 48*c*3 is a plate member (tab) that can be grasped when the cover 48 is removed from the process case 41, and is provided to spread outward from the connecting member 48*c*1. Also, a shaft storing portion 48*d* as a slit-like through hole into which one end portion of the drum shaft 42*b* is stored is formed in the connecting member 48*c*1.

As described above, in the present embodiment, the releasing members 48*b*1 and 48*b*2 are arranged in the unreleased positions immediately after the cover 48 is fitted to the process case 41 and the cover main body 48*a* covers the photosensitive drum 42, and then these members can move from the unreleased positions to the released positions.

As used herein, the state in which the cover 48 is fitted to the process case 41 (and the cover main body 48 covers the photosensitive drum 42) (hereinafter also referred to as a "fitting state") is, for example, a state in which the movement of the cover main body 48*a* is regulated by a fitting, an abutment, or an engagement between a part of the cover 48 (e.g., the both end portions in the axial direction and/or the upper surface) and the process case 41. In other words, providing that the cover 48 is moved relative to the process case 41 in a first direction when the cover 48 is fitted to the process case 41 and in a second direction opposite to the first direction when the cover 48 is removed from the process case 41, the fitting state prevents the cover 48 from moving further in the first direction.

Also, by reference to FIG. 3C and FIG. 5, in the present embodiment, the releasing members 48*b*1 and 48*b*2 are provided to be exposed to the outside of the process cartridge 4 in a state that the cover 48 is fitted to the process case 41 and the cover main body 48*a* covers the photosensitive drum 42. That is, it can be viewed from the outside whether the releasing members 48*b*1 and 48*b*2 are positioned in the unreleased positions or the released positions.

<Outline of Operation of Configuration of Embodiment>

An outline of an operation executed by the configuration of the present embodiment will be explained by referring to the drawings appropriately hereunder.

<<Image Forming Operation>>

First, by reference to FIG. 1, the uppermost sheet of many papers stacked in the paper cassette 3 by the paper feeding portion 21 is picked up from the paper cassette 3. This paper P is fed to the position on the upstream side of the process cartridge 4Y on the paper feeding belt 23*c* (the position between the photosensitive drum 42 and one of a pair of belt driving rollers 23*b* in the process cartridge 4Y) by the paper feeding portion 21. The paper P is attracted to the paper feeding belt 23*c* in this position, and also is fed to the downstream side in the paper feeding direction together with movement of the paper feeding belt 23*c*.

While the paper P is carried to the position where the photosensitive drum 42 in each process cartridge 4 opposes to the corresponding transfer roller 23*a*, the toner is carried like an image on the latent image forming surface 42*a* in the photosensitive drum 42 (i.e., the toner image is formed) in the manner described hereunder.

By reference to FIG. 1 and FIG. 2, first the latent image forming surface 42*a* in the photosensitive drum 42 is cleaned by the cleaning mechanism 47. Then, the latent image forming surface 42*a* is charged uniformly by the charger 46. Then, a laser beam of a predetermined wavelength that is modulated in response to the image information is irradiated to the latent image forming surface 42*a*, which is charged uniformly as descried above, by the exposing portion 22. Accordingly, the electrostatic latent image is formed on the latent image forming surface 42*a*.

The latent image forming surface 42*a* on which the electrostatic latent image is formed arrives at the position where the photosensitive drum 42 contacts the developing roller 44, according to the rotation of the photosensitive drum 42. The electrostatic latent image on the latent image forming surface 42*a* is developed by the uniform thin-layer toner that is carried on the peripheral surface of the rotating developing roller 44. The latent image forming surface 42*a*, on which the electrostatic latent image is developed by the toner, is moved to the position that opposes to the transfer roller 23*a* via the paper feeding belt 23*c*, according to the rotation of the photosensitive drum 42. The toner being carried on the latent image forming surface 42*a* is transferred to the paper P that is attracted by the paper feeding belt 23*c*, in this position.

Returning to FIG. 1 again, after the paper P passes through the process cartridges 4Y, 4M, 4C, and 4K, at least one of the toner images formed by yellow, magenta, cyan, and black toners is transferred to the paper P depending on the situation (in response to the color tone of the to-be formed image).

Here, the process cartridges 4Y, 4M, 4C, and 4K are aligned in predetermined positions with respect to the main body portion 2, i.e., the transferring portion 23, as described later. As a result, the toner images corresponding to multiple color (full color) image using above four colors can be formed well on the paper P (in the case of image formation corresponding to the monochrome original, of course the toner image formed only by the black toner in the process cartridge 4K, for example, is formed on the paper P).

The toner images formed on the surface of the paper P after the paper P passed through the process cartridges 4Y, 4M, 4C, and 4K are fixed to the paper P by the heat and pressure applied by the fixing portion 24 when this paper P passes through the fixing portion 24. The paper P on which the toner images are fixed by the fixing portion 24 is ejected to the outside of the main body portion 2 by the paper ejecting portion 25.

<Process Cartridge Handling Operation>

Next, an operation in handling the process cartridge 4 of the present embodiment (especially, in fitting the cover 48 to the process case 41) will be explained by referring appropriately to respective figures hereunder.

Immediately after the process cartridge 4 is manufactured, or immediately after the process cartridge 4 is detached from the main body portion 2 of the laser printer 1, as shown in FIG. 3A, the cover 48 is not fitted to the process case 41. In this state, in order to protect the latent image forming surface 42*a* of the photosensitive drum 42 from an impact or a contact from the outside, the cover 48 must be fitted quickly to the process case 41.

In fitting the cover 48 to the process case 41, first the connecting member 48*c*2 is "engaged" with the engaging projecting portion 41*c*1 (see FIG. 5), as shown in FIG. 7A. At this time, the releasing member 48*b*2 (see FIG. 5 and FIG. 6) is positioned in the unreleased position by the elastic deformation of the connecting member 48*c*2.

Then, the connecting member 48*c*1 side of the cover 48 is moved toward the process case 41 until the drum shaft 42*b* is stored in the shaft storing portion 48*d*, as shown in FIG. 7B. At this time, the drum shaft 42*b* protruded from the process case 41 comes into contact with the "inside" surfaces of the grasping member 48*c*3 and the connecting member 48*c*1, and thus the connecting member 48*c*1 is elastically deformed to easily bend "outward".

In the state immediately after the drum shaft 42*b* is stored in the shaft storing portion 48*d*, i.e., immediately after the cover 48 is fitted to the process case 41, the photosensitive drum 42 is protected by the cover main body 48*a* whereas the releasing members 48*b*1 and 48*b*2 are located in the unreleased position. At this time, the photosensitive drum 42 and the developing roller 44 are brought into a mutual contact state (see FIG. 3B).

Then, when the developing unit 43 is slightly moved against the load of the urging lever 45*a* (the spring 45*b*) by the finger of human being, the releasing members 48*b*1 and 48*b*2 are inserted into the released position on the "inner side" by the elasticity of the connecting members 48*c*1 and 48*c*2. Thus, the contact between the photosensitive drum 42 and the developing roller 44 is released. Accordingly, the damage (pressured indent or soiling) caused in the process cartridge 4 preserved for a long term when the contact between the photosensitive drum 42 and the developing roller 44 is kept for a long term can be prevented effectively.

Before the process cartridge 4 is fitted to the main body portion 2 of the laser printer 1, the cover 48 is removed from the process case 41. This removal is done very easily by grasping the grasping member 48*c*3. Then, the process cartridge 4 is fitted to the main body portion 2. At this time, the engaging projecting portion 41*c*1 is used in positioning the process cartridge 4 with the main body portion 2.

<Effects/Advantages by Configuration of Embodiment>

As described above, in the present embodiment, immediately after the cover 48 is fitted to the process case 41, the releasing members 48*b*1 and 48*b*2 are positioned in the unreleased position respectively and also the releasing members 48*b*1 and 48*b*2 are moved from the unreleased position to the released position by the later operation. In other words, the direction in which the releasing members 48*b*1 and 48*b*2 move from the unreleased position to the released position is different from the direction for fitting the cover to the process cartridge. That is, the fitting operation of the cover 48 to the process case 41 and the releasing operation between the photosensitive drum 42 and the developing roller 44 by moving the releasing members 48*b*1 and 48*b*2 from the unreleased position to the released position are executed in sequence in two steps.

Thus, according to the configuration of the present embodiment, the cover 48 can be fitted smoothly to the process case 41. That is, because the force required to release the contact between the photosensitive drum 42 and the developing roller 44 is superposed, the fitting operation of the cover 48 is never done inadvertently "strongly".

Accordingly, the damage of the latent image forming surface 42*a* caused when the cover 48 is fitted to the process case 41 can be suppressed satisfactorily. Then, the releasing members 48*b*1 and 48*b*2 are caused to move from the unreleased position to the released position after the cover 48 is fitted smoothly to the process case 41. Thus, the contact between the photosensitive drum 42 and the developing roller 44 can be released satisfactorily and perfectly.

In the present embodiment, the connecting member 48*c*1 is formed of a thin flat plate whereas the connecting member 48*c*2 is formed into a shape that engages with the engaging projecting portion 41*c*1 (that "engages" with the cylindrical engaging projecting portion 41*c*1).

Therefore, according to the configuration of the present embodiment, as given in the above explanation of operation, the cover 48 can be fitted simply and smoothly to the process case 41 through the procedures such that the connecting member 48*c*2 "engages" with the engaging projecting portion 41*c*1, then the connecting member 48*c*1 is bent "outward" by the drum shaft 42*b*, and finally the drum shaft 42*b* is caused to be stored in the shaft storing portion 48*d*.

In the present embodiment, the restricting rib 41*d* is provided to the side to which the releasing members 48*b*1 and 48*b*2 are moved when these members receive the load, which is required to contact the photosensitive drum 42 and the developing roller 44, from the developing roller shaft bearing 44*b* in a situation that the releasing members 48*b*1 and 48*b*2 are located in the released position.

Therefore, according to the configuration of the present embodiment, when received the above load, the releasing members 48*b*1 and 48*b*2 located in the released position come into contact with the restricting rib 41*d*. Thus, the releasing members 48*b*1 and 48*b*2 are held good in the released position. Therefore, the separated condition between the developing roller 44 and the photosensitive drum 42 can be held clearly.

In the present embodiment, the engaging projecting portion 41*c*1 used to align the process cartridge 4 with the main body portion 2 is protected satisfactorily by the connecting member 48*c*2 of the cover 48.

Therefore, according to the configuration of the present embodiment, a distraction of the formed image caused due to displacement of the process cartridge 4 with respect to the main body portion 2 of the laser printer 1 can be suppressed satisfactorily.

In the present embodiment, the releasing members 48*b*1 and 48*b*2 are exposed to the outside of the process cartridge 4 when the releasing members 48*b*1 and 48*b*2 are located in either of the unreleased position and the released position in a state that the cover 48 is fitted to the process case 41 and the cover main body 48*a* covers the photosensitive drum 42.

Therefore, according to the configuration of the present embodiment, in such a state that the cover 48 is fitted to the process case 41 and the cover main body 48*a* covers the photosensitive drum 42, it can be checked surely whether the releasing members 48*b*1 and 48*b*2 are located in the unreleased position or in the released position.

In this manner, according to the present embodiment, the photosensitive drum 42 can be protected more adequately with a simple device structure.

<Exemplifications of Variations>

As described above, the above embodiments merely illustrates the typical embodiments of the present invention that are considered by the applicant of this application as the best mode for the present at a point of time of this application. Therefore, it should be interpreted that no limitation is imposed on the present invention including the above embodiment. As a result, it is of course that various variations can be applied to the above embodiments within a scope of the present invention.

Several typical variations will be illustrated hereunder. Indeed, it is needless to say that variations are not limited to those listed hereunder. Also, all or a part of the embodiments and the variations can be applied appropriately in combination mutually within a technically consistent range.

The present invention should not be interpreted limitatively based on recitations of the above embodiments and following variations.

(1) The application object is not limited to the color laser printer. For example, the present invention can be applied preferably to the image forming apparatus of the so-called electrophotographic system such as the monochromatic laser printer, the monochromatic or color copying machine, or the like.

(2) An intermediate transfer belt, on a surface of which the toner image can be carried, may be employed instead of the paper feeding belt 23*c* employed in the above embodiment. In this case, the configuration of the paper feeding portion 21, arrangements of the fixing portion 24 and the paper ejecting portion 25, and the mode of the paper feeding path PP based upon them may be changed appropriately from those in FIG. 1.

(3) Also, the configuration of the process case 41 is not limited to that in the above embodiment. For example, the engaging projecting portion 41*c*1 may be provided instead of the drum storing portion 41*c*2 in the above embodiment. That is, a pair of engaging projecting portions 41*c*1 may be provided to both end portions of the process case 41 in the axial direction. Otherwise, the drum storing portion 41*c*2 may be provided instead of the engaging projecting portion 41*c*1 in the above embodiment.

(4) The present invention is not limited to the configuration in which the photosensitive drum 42 and the developing roller 44 are provided to the detachably attachable separate units respectively, like the above embodiment. That is, for example, the process case 41 and the developing unit case 43*a* may be formed integrally.

Also, the configuration to allow the photosensitive drum 42 and the developing roller 44 to be relatively move between the contact position in which they contact each other and the separated position in which they are separated from each other is not limited to that in the above embodiment (the configuration in which the developing unit 43 is slid in the process case 41).

For example, the following configuration may be considered. That is, the process case 41 equipped with the photosensitive drum 42 and the developing unit 43 equipped with the developing roller 44 are joined around the common axis like a V-shape or an inverted V-shape. The arrangement of the photosensitive drum 42 in the process case 41 and the arrangement of the developing roller 44 in the developing unit 43 are set appropriately such that the photosensitive drum 42 and the developing roller 44 are opposed to each other. The process case 41 and the developing unit 43 are configured such that, when the developing unit 43 is swung (rotated) around the above shaft, the photosensitive drum 42 and the developing roller 44 can relatively move between the contact position and the separated position.

Also, the configuration employing the so-called developing sleeve as the developing roller 44 (the configuration equipped with the sleeve formed of a metal or a conductive (semi-conductive) synthetic resin film, and the elastic roller arranged on the inside of this sleeve) can be employed. That is, the "developing roller" may include the configuration consisting of the developing sleeve and the elastic roller described above (it is possible to say such configuration as the "developing roller" in a social common idea or in view of the technical common sense of the person skilled in the art).

(5) The configuration of the cover 48 is not limited to those disclosed concretely in the above embodiments. That is, the configuration of the cover 48 in the above embodiments can be changed appropriately within a scope of the present invention.

The movement (insertion) of the releasing members 48*b*1 and 48*b*2 to the released position can be done without the operation of moving the developing unit 43 against the load applied by the urging lever 45*a* (the spring 45*b*). Concretely, the releasing members 48*b*1 and 48*b*2 can be moved from the unreleased position to the released position by "pushing" the releasing members 48*b*1 and 48*b*2 into the inside, for example. For such purpose, the releasing members 48*b*1 and 48*b*2 can be formed to have a "wedge" shaped portion when viewed from the top, i.e., a portion shaped such that its sectional area is decreased smaller toward its top end portion that contacts the side plate 41*b*, at the top end (see the releasing member 48*b*2 in FIG. 6).

The configuration for holding the releasing members 48*b*1 and 48*b*2 in the released position is not limited to the above embodiments. For example, the column-like projection, or the like equivalent to this rib (one or plural projections per one side plate 41*b*) can be employed in place of the restricting rib 41*d*.

Alternately, concave portions may be provided on portions opposing (contacting) to the releasing members 48*b*1 and 48*b*2 on the side plate 41*b*, and convex portions that engage with such concave portions may be provided to the releasing members 48*b*1 and 48*b*2. Conversely, convex portions may be provided on portions opposing (contacting) to the releasing members 48*b*1 and 48*b*2 on the side plate 41*b*, and concave portions that engage with such convex portions may be provided to the releasing members 48*b*1 and 48*b*2.

Figure 8:
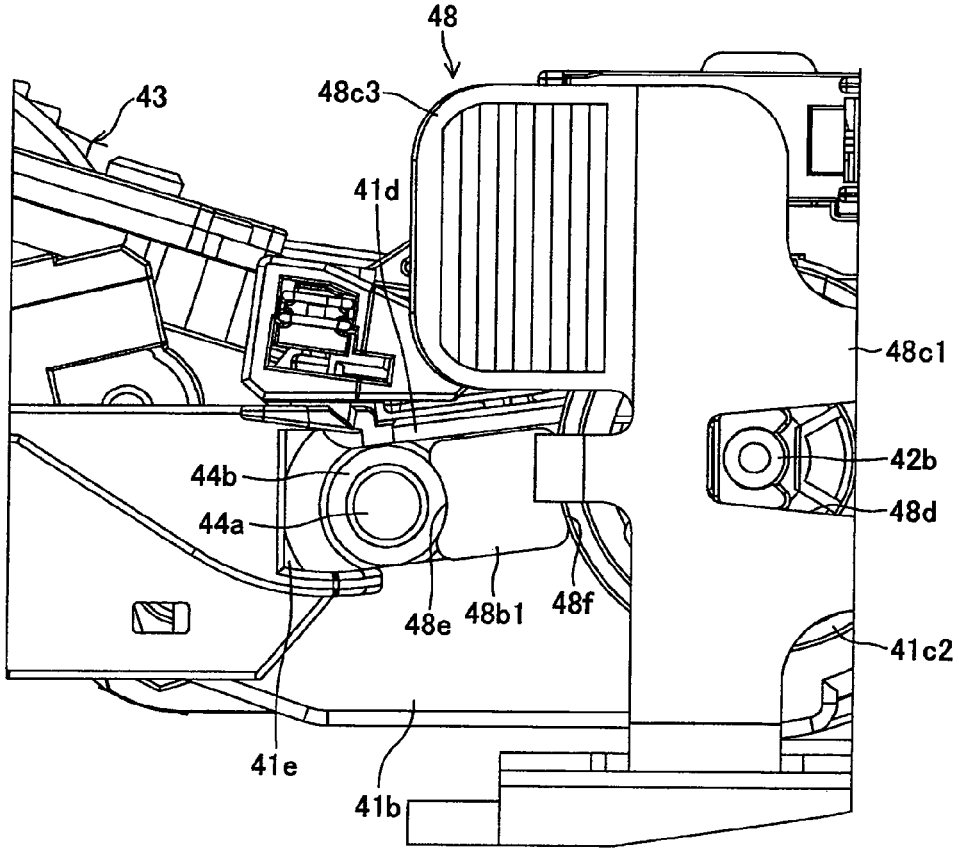
FIG. 8 is an enlarged side view showing a configuration of a variation of a cover shown in FIG. 3B to FIG. 7B.

FIG. 8 is an enlarged side view showing a configuration of a variation of the cover 48 shown in FIG. 3B to FIG. 7B. By reference to FIG. 8, an engaging recess 48*e* can be provided to the end surface opposing to the developing roller shaft bearing 44*b* in the releasing member 48*b*1. This engaging recess 48*e* is formed to have a shape that engages with the developing roller shaft bearing 44*b*. Such engaging recess 48*e* can also be formed on the releasing member 48*b*2.

Also, an engaging recess 48*f* can be provided to the end surface opposing to the drum storing portion 41*c*2 in the releasing member 48*b*1. This engaging recess 48*f* is formed to have a shape that engages with the drum storing portion 41*c*2. Such engaging recess 48*f* can also be formed on the releasing member 48*b*2.

In this case, any one of the engaging recesses 48*e* and 48*f* may be employed or both of them may be employed. Also, the engaging recesses 48*e* and/or 48*f* can be employed together with the concave or convex portion that is provided on the surface of the side plate 41*b* opposing (contacting) the releasing members 48*b*1 and 48*b*2, as described above.

Figure 9:
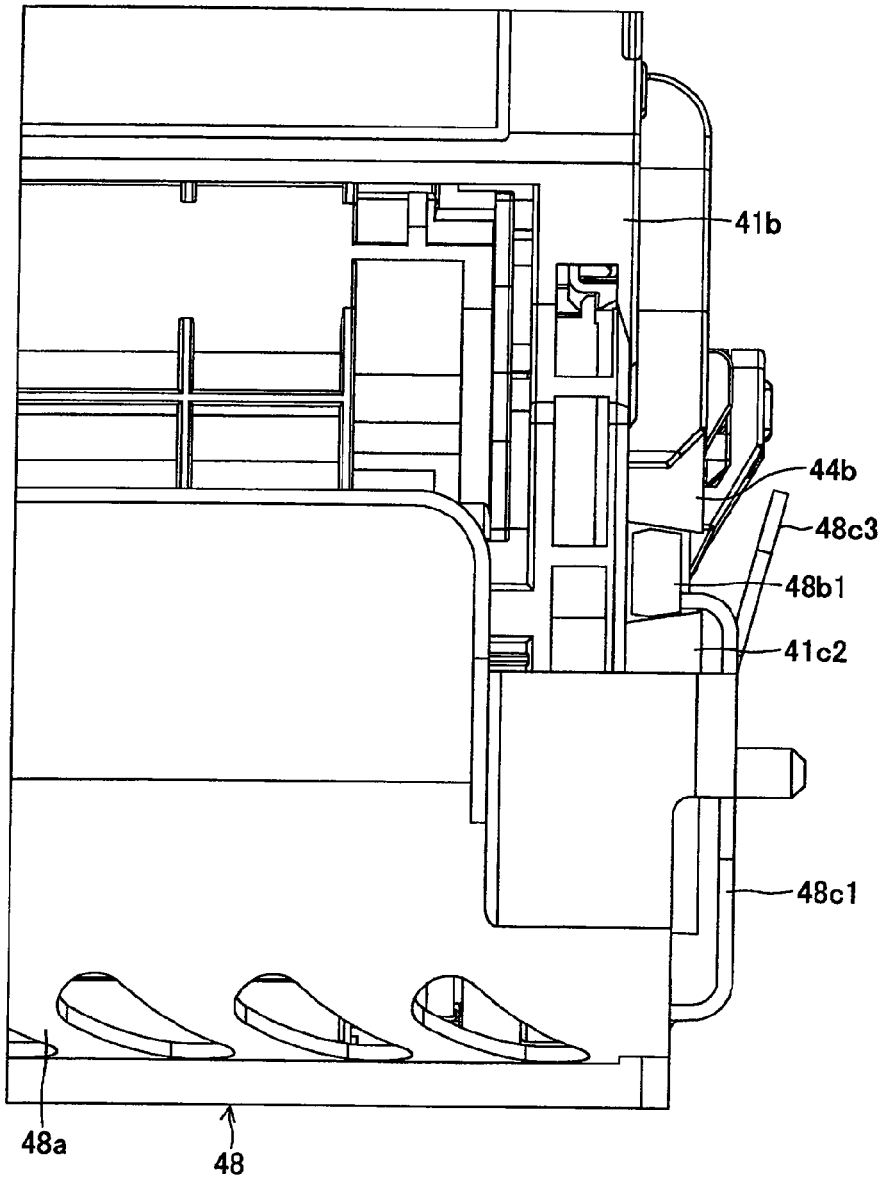
FIG. 9 is an enlarged side view showing a configuration of another variation of the cover shown in FIG. 3B to FIG. 7B.

FIG. 9 is an enlarged side view showing a configuration of another variation of the cover 48 shown in FIG. 3B to FIG. 7B. By reference to FIG. 9, outer shapes of the releasing member 48*b*1, the drum storing portion 41*c*2, and the developing roller shaft bearing 44*b* may be set such that, when the releasing member 48*b*1 arranged in the released position is sandwiched between the drum storing portion 41*c*2 and the developing roller shaft bearing 44*b* and then is urged toward the inner side in the axial direction of the photosensitive drum 42 (see FIG. 7A, etc.) by the above load, theses members come into contact with the outer wall of the side plate 41*b* from the outside.

Concretely, for example, in this case, an interval between the surfaces, which oppose to the releasing member 48*b*1 respectively, of the drum storing portion 41*c*2 and the developing roller shaft bearing 44*b* is expanded gradually toward the inner side in the axial direction of the photosensitive drum 42 (see FIG. 7A, etc.) when viewed from the bottom (or viewed from the top). At this time, the releasing member 48*b*1 is formed as an almost trapezoid shape that is expanded gradually toward the inner side in the above axial direction when viewed from the bottom (or viewed from the top).

Similarly, outer shapes of the releasing member 48*b*2, the engaging projecting portion 41*c*1, and the developing roller shaft bearing 44*b* may be set such that, when the releasing member 48*b*2 arranged in the released position is sandwiched between the engaging projecting portion 41*c*1 and the developing roller shaft bearing 44*b* and then is urged toward the inner side in the axial direction by the above load, theses members come into contact with the outer wall of the side plate 41*b* from the outside.

The connecting member 48*c*2 may be formed so as to be difficult to elastic deform such that the releasing member 48*b*2 can be inserted naturally from the unreleased position to the released position along with the shift from the state in FIG. 7A to the state in FIG. 7B.

The releasing member 48*b*1 and the connecting member 48*c*1 may be provided to both end portions of the cover 48 in the axial direction of the photosensitive drum 42. Otherwise, the releasing member 48*b*2 and the connecting member 48*c*2 may be provided to both end portions of the cover 48 in the axial direction of the photosensitive drum 42.

Figure 10:
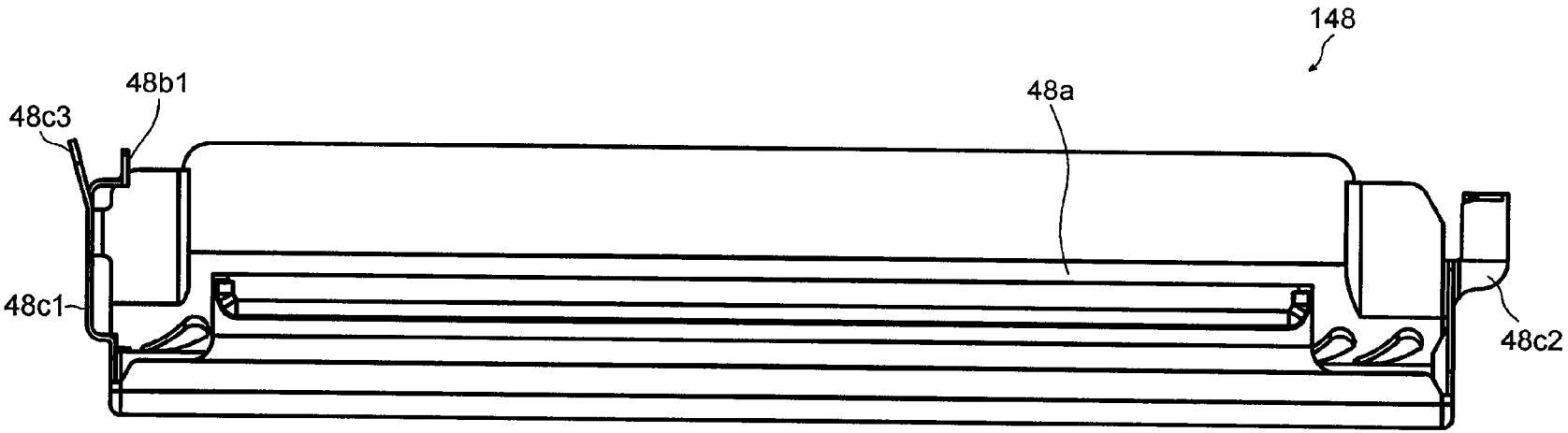
FIG. 10 is a plan view showing a modification of a cover shown in FIG. 3B to FIG. 7B.
Figure 11:
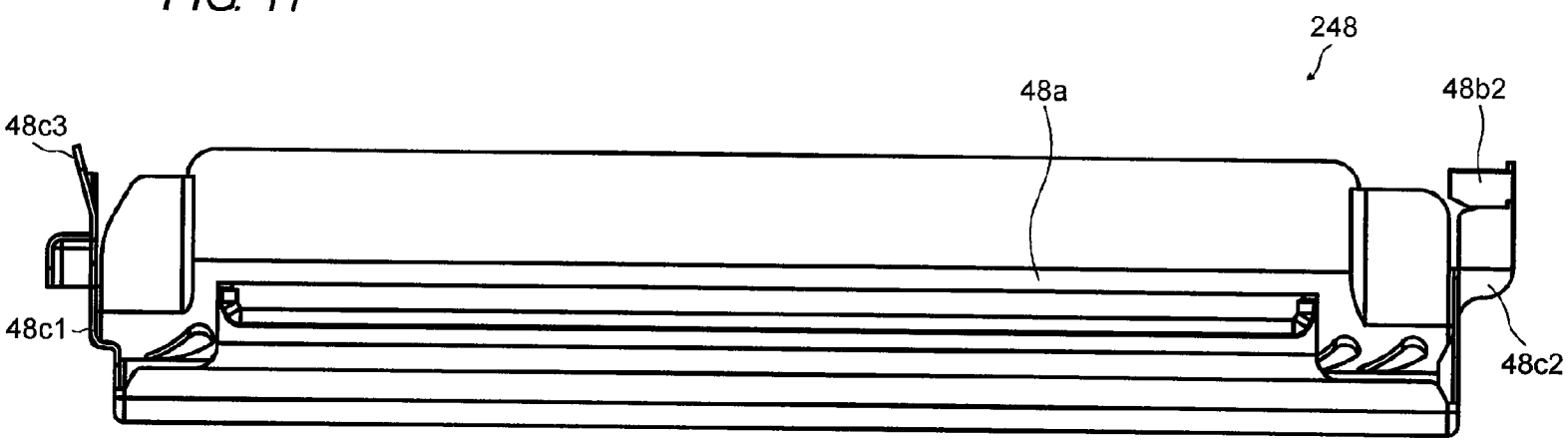
FIG. 11 is a plan view showing a modification of a cover shown in FIG. 3B to FIG. 7B.

In the embodiments, the releasing members 48*b*1 and 48*b*2 are provided at the cover 48, but only one of the releasing members 48*b*1 and 48*b*2 may be provided. In other words, the releasing members 48*b*1 and 48*b*2 are provided at both end portions of the cover 48, but only one of the releasing members 48*b*1 and 48*b*2 may be provided at one end portion of the cover 48. For example, as shown in FIG. 10, the cover 148 may include the releasing member 48*b*1 at one end portion thereof, but no releasing member at the other end portion thereof. In contrast, as shown in FIG. 11, the cover 248 may include no releasing member at one end portion thereof but the releasing member 48*b*2 at the other end portion thereof. Even when the cover 148 or 248 is mounted and the releasing member 48*b*1 or 48*b*2 is positioned at the released position, since the releasing member 48*b*1 or 48*b*2 is provided at only one of the end portions, the developing roller 44 and the photosensitive drum 42 are separated from each other on a side of the one of the end portions, but the developing roller 44 and the photosensitive drum 42 contact each other on the other side of the one of the end portions.

(6) Besides, although not mentioned specifically, appropriate variations can be applied to the configurations shown in the above embodiment within a scope that does not depart from a gist of the present invention. Also, the elements expressed operationally/functionally in elements of the claims contain all configurations that can implement the operations and the functions, in addition to the concrete configurations disclosed in the above embodiment and the variations.

According to the embodiments of the invention, a process cartridge can be detachably attached to a main body of an image forming apparatus. The process cartridge includes an image carrier, a developing roller, a process case, a cover, and a pair of releasing members.

The image carrier is formed of a cylindrical member on which an electrostatic latent image is formed. The developing roller is formed of a circular column member that carries a developer on a peripheral surface. When the developing roller contacts the image carrier during an image forming operation, the developing roller develops the electrostatic latent image by the developer.

The image carrier and the developing roller are stored in the process case such that the image carrier and the developing roller are relatively movable between a contact position in which they contact each other and a separated position in which they are separated from each other. When this cover is fitted to the process case, the cover covers the image carrier in a state in which the process cartridge is detached from the main body (this state may include any unfitted state, e.g.,. the case where the process cartridge is a new product and has never been fitted to the main body of the image forming apparatus).

A pair of releasing members are provided to both end portions of the cover in an axial direction of the image carrier. The pair of releasing members release the contact between the image carrier and the developing roller when the releasing members are interposed into the released positions (positions between both end portions in the axial direction of the image carrier and both end portions in the axial direction of the developing roller).

For example, when these releasing members move from the unreleased position to the released position, the releasing members urge the end portion of the developing roller shaft constituting the rotation center axis of the developing roller to release a contact between the image carrier and the developing roller.

At least one (one or both) of a pair of releasing members is moved from the unreleased position, in which a contact between the image carrier and the developing roller is not released, to the released position in a state that the cover is fitted to the process case and covers the image carrier.

In such configuration, the cover is fitted to the process case in a state that the process cartridge is detached from the main body of the image forming apparatus. Accordingly, the image carrier provided to the process cartridge is covered with the cover, and the image carrier is protected from an impact, or the like from the outside with the cover. At this time, at least one of releasing members can be arranged in the unreleased position.

Then, the members (one or both), which are positioned in the unreleased position, of a pair of releasing members are moved to the released position. Then, a contact between the developing roller and the image carrier is released. Accordingly, the damage of the image carrier caused as above can be suppressed effectively.

In this manner, in such configuration, the cover is fitted to the process case to cover the image carrier and the image carrier is protected by the cover, and then such a state can be realized that both of a pair of releasing members are arranged (inserted) in the released position. Therefore, a contact between the developing roller and the image carrier can be released satisfactorily and perfectly. That is, the fitting operation of the cover to the process case and the contact releasing (separating) operation between the developing roller and the image carrier can be executed in this sequence in two steps.

Therefore, according to such configuration, the cover can be fitted smoothly to the process case. That is, because the force required to release a contact between the developing roller and the image carrier is superposed, such an event can be suppressed satisfactorily that the fitting operation of the cover is done inadvertently "strongly" and thus the peripheral surface of the image carrier (referred to the "image carrying surface" or the "latent image forming surface" hereinafter) is damaged. Also, a contact between the developing roller and the image carrier can be released satisfactorily and perfectly after the cover is fitted smoothly to the process case.

The process cartridge can be configured as follows. That is, at least one (one or both) of a pair of releasing members is formed integrally with the cover via a flexible connecting member that deforms elastically. Then, the releasing member is positioned in the unreleased position by means of an elastic deformation of the connecting member when the cover is fitted to the process case to cover the image carrier.

In such configuration, when the cover is fitted to the process case to cover the image carrier, the releasing member formed integrally with the cover via the flexible connecting member is positioned in the unreleased position due to the elastic deformation of the connecting member. Such releasing member is moved from the unreleased position to the released position after the image carrier is covered with the cover. At this time, a contact between the developing roller and the image carrier is released.

The process cartridge can be configured as follows. That is, each of a pair of releasing members is formed integrally with the cover via the connecting member. Also, one of a pair of connecting members is configured to elastically deform more easily than the other (member different from above one member).

In such configuration, when the cover is fitted to the process case to cover the image carrier, one of the releasing members formed integrally with the cover via the connecting member is positioned in the unreleased position due to the elastic deformation of one member, which is ready to deform, of a pair connecting members.

Therefore, the cover can be fitted to the process case by the following method, for example. That is, first the end portion in the axial direction of the cover, which corresponds to the other connecting member (member different from above one member) and the releasing member connected to this member, is engaged with the process case. Then, the end portion in the axial direction of the cover, which corresponds to the connecting member and the releasing member connected to this member, is engaged with the process case while elastically deforming one of connecting members on the opposite side. At that time, the releasing members can be positioned in the unreleased position. Then, the releasing members are forced to move from the unreleased position to the released position.

One of a pair of connecting members is pushed by one end portion of a drum shaft, which constitutes a rotation center axis of the image carrier, to elastically deform when the cover is fitted to the process case to cover the image carrier.

In such configuration, when the cover is fitted to the process case to cover the image carrier, one of a pair of connecting members, which is deformed more easily, is pushed by one end of the drum shaft. Accordingly, the connecting member is elastically deformed, and one of the releasing members, which is formed integrally via the connecting member, is moved smoothly to the unreleased position.

A shaft storing portion can be formed in one of a pair of connecting members. When the cover is fitted to the process case to cover the image carrier, one end portion of the drum shaft is stored in the shaft storing portion.

In such configuration, when the cover is fitted to the process case to cover the image carrier, one of the connecting members is pushed by one end portion of the drum shaft. Then, the connecting member is elastically deformed. Accordingly, one of releasing members formed integrally via the connecting member is moved smoothly to the unreleased position. Then, one end portion of the drum shaft is stored in the shaft storing portion.

An engaging projecting portion used to position the process cartridge with respect to the main body of the image forming apparatus is provided to an end portion in the axial direction of the process case. This engaging projecting portion can be shaped cylindrically to support rotatably an end portion in the axial direction of the image carrier. In this case, the other of a pair of connecting members is configured to cover the engaging projecting portion when the cover is fitted to the process case to cover the image carrier.

In such configuration, when the cover is fitted to the process case, the engaging projecting portion is covered with the cover (the connecting member). At this time, the engaging projecting portion used to position the process cartridge with respect to the main body of the image forming apparatus can be protected satisfactorily. As a result, a distraction of the formed image caused due to displacement of the process cartridge with respect to the main body portion of the image forming apparatus can be suppressed satisfactorily.

The process cartridge further includes holding mechanisms for holding the releasing members in the unreleased position.

For example, the holding mechanism can be formed by the restricting member (rib, projection, or the like) provided to the process case. This restricting member is arranged on the side to which the releasing members are moved when the load for causing the image carrier and the developing roller to contact is applied in a situation that the releasing members are in the released position. The restricting member is provided such that, when the above load is applied to the releasing members, this restricting member comes into contact with the releasing members to hold the releasing members in the released position.

Alternately, the holding mechanism can be configured by the releasing members whose outer shape can be engaged with the above engaging projecting portion and/or the carrier (the member that covers the end portion of the developing roller shaft) in the released position. Concretely, for example, the recess portion that can engage with the engaging projecting portion and/or the carrier can be provided on the releasing members.

Otherwise, the holding mechanism can be configured by the releasing members, the carrier, and the engaging projection portions, which are set to a predetermined outer shape respectively. The "predetermined outer shape" in this case signifies concretely the shape that can come into contact the side plate of the process case from the outside when the releasing members are urged to the inner side in the axial direction by the above load in a state that the releasing members arranged in the released position are put between the carrier and the engaging projecting portion.

According to such configuration, such a state can be maintained satisfactorily that a contact between the developing roller and the image carrier is released by the releasing embers.

Both of a pair of releasing members can be exposed to an outside of the process cartridge in a state that the cover is fitted to the process case to cover the image carrier.

According to such configuration, it can be checked surely whether a pair of releasing members are positioned in the unreleased position or in the released position in a state that the cover is fitted to the process case to cover the image carrier.

As described above, according to the embodiments of the present invention, the cover is fitted smoothly to the process case and the image carrier is covered with the cover. After this, a contact between the developing roller and the image carrier is released by arranging (inserting) both of a pair of releasing members in the released position. Therefore, according to the embodiments of the present invention, the image carrier can be protected more adequately with a simple device structure.

What is claimed is:

1. A process cartridge detachably attachable to a main body of an image forming apparatus, said process cartridge comprising:

a cylindrical image carrier extending in an axial direction thereof from a first end portion thereof to a second end portion thereof, the image carrier on which an electrostatic latent image is formed;

a column developing roller extending substantially along the axial direction from a first end portion thereof to a second end portion thereof, the developing roller being configured to carry a developer on a peripheral surface thereof so as to develop the electrostatic latent image by the developer when the developing roller contact the image carrier during an image forming operation;

a process case configured to store the image carrier and the developing roller such that the image carrier and the developing roller are relatively movable between a contact position in which the image carrier contacts the developing roller and a separated position in which the image carrier is separated from the developing roller;

a cover removably fitted to the process case so as to cover the image carrier in a state in which the process cartridge is detached from the main body of the image forming apparatus, the cover having a first end portion and a second end portion opposite to the first end portion in the axial direction when the cover is fitted to the process case; and a first releasing member provided at the first end portion of the cover, the first releasing member being configured to release a contact between the image carrier and the developing roller when the first releasing member is interposed into a first released position between the first end portion of the image carrier and the first end portion of the developing roller;

wherein the first releasing member is movable from a first unreleased position, in which the contact between the image carrier and the developing roller is not released, to the first released position in a state in which the cover is fitted to the process case and covers the image carrier.

2. The process cartridge according to claim 1, wherein the first releasing member is formed integrally with the cover via a flexible first connecting member that is elastically deformable, and is positioned in the first unreleased position by means of an elastic deformation of the first connecting member when the cover is fitted to the process case to cover the image carrier.

3. The process cartridge according to claim 2, further comprising a second releasing member provided at the second end portion of the cover, the second releasing member being configured to release the contact between the image carrier and the developing roller when the second releasing member is interposed into a second released position between the second end portion of the image carrier and the second portion of the developing roller;

wherein the second releasing member is movable from a second unreleased position, in which the contact between the image carrier and the developing roller is not released, to the second released position in a state in which the cover is fitted to the process case and covers the image carrier.

4. The process cartridge according to claim 3, wherein the second releasing member is formed integrally with the cover via a second connecting member that is elastically deformable, and is positioned in the second unreleased position by means of an elastic deformation of the second connecting member when the cover is fitted to the process case to cover the image carrier, and wherein the first connecting member is elastically deform more easily than the second connecting member.

5. The process cartridge according to claim 4, wherein the first connecting member is pushed by a first end portion of a drum shaft extending in a rotation center axis of the image carrier, so as to elastically deform during a course of a fitting of the cover to the process case.

6. The process cartridge according to claim 5, wherein the first connecting member has a shaft storing portion that stores therein the first end portion of the drum shaft when the cover is fitted to the process case to cover the image carrier.

7. The process cartridge according to claim 4, wherein an engaging projecting portion is provided to an end portion of the process case in the axial direction, the engaging projection portion that positions the process cartridge with respect to the main body of the image forming apparatus when the process cartridge is attached to the image forming apparatus, and wherein the second connecting member covers the engaging projecting portion when the cover is fitted to the process case to cover the image carrier.

8. The process cartridge according to claim 7, wherein the engaging projecting portion has a cylindrical shape so as to rotatably support the second end portion of the image carrier.

9. The process cartridge according to claim 1, wherein the first releasing member urges an end portion of a developing roller shaft constituting the rotation center axis of the developing roller so as to release the contact between the image carrier and the developing roller when the first releasing member is moved from the first unreleased position to the first released position.

10. The process cartridge according to claim 1, further comprising a holding mechanism configured to hold the first releasing member in the first unreleased position.

11. The process cartridge according to claim 1, wherein the first releasing member is exposed from the cover to an outside of the process cartridge in a state that the cover is fitted to the process case to cover the image carrier.

12. The process cartridge according to claim 1, wherein the image carrier and the developing roller are positioned at the separated position only when an external force is applied to move at least one of the image carrier and the developing roller, wherein the first releasing member is positioned at the first unreleased position when the cover is fitted to the process case in a state in which the image carrier and the developing roller are positioned at the contact position, and wherein the first releasing member moves from the first unreleased position to the first released position when the image carrier and the developing roller are positioned at the separated position in a state in which the cover is fitted to the process case.

13. The process cartridge according to claim 1, wherein the first releasing member at the first unreleased position is located outside of the image carrier and the developing roller in the axial direction.

14. The process cartridge according to claim 1, wherein no releasing member is provided at the second end portion of the cover.

15. A process cartridge detachably attachable to a main body of an image forming apparatus, said process cartridge comprising:

an image carrier extending in an axial direction thereof;

a developing roller extending substantially along the axial direction;

a process case configured to store the image carrier and the developing roller such that the image carrier and the developing roller are relatively movable between a contact position in which the image carrier contacts the developing roller and a separated position in which the image carrier is separated from the developing roller; and a cover removably fitted to the process case so as to cover the image carrier in a state in which the process cartridge is detached from the main body of the image forming apparatus, the cover comprising a releasing member movable from a first position to a second position in a first direction relative to the process case in a state in which the cover is fitted to the process case, wherein the releasing member is positioned at the first position when the image carrier and the developing roller are positioned at the contact position, wherein the releasing member positioned at the second position is interposed between the developing roller and the movable which are positioned at the separated position, and wherein the first direction is different from a second direction for fitting the cover to the process cartridge.

16. A process cartridge detachably attachable to a main body of an image forming apparatus, said process cartridge comprising:

an image carrier extending in an axial direction thereof;

a developing roller extending substantially along the axial direction;

a process case configured to store the image carrier and the developing roller such that the image carrier and the developing roller are relatively movable between a contact position in which the image carrier contacts the developing roller and a separated position in which the image carrier is separated from the developing roller; and a cover removably fitted to the process case so as to cover the image carrier in a state in which the process cartridge is detached from the main body of the image forming apparatus, the cover comprising a releasing member movable from a first position to a second position in a state in which the cover is fitted to the process case, wherein the releasing member is positioned at the first position when the image carrier and the developing roller are positioned at the contact position, wherein the releasing member positioned at the second position is interposed between the image carrier and the developing roller which are positioned at the separated position, and wherein when a state of the cover is changed from a removed state to a fitted state with respect to the process case, the releasing member is positioned at the first position.

* * * * *